United States Patent [19]

Ott

[11] 4,109,322

[45] Aug. 29, 1978

[54] SUN SHIELD

[76] Inventor: Charlotte A. Ott, 1051 S. Dobson, #65, Mesa, Ariz. 85202

[21] Appl. No.: 804,911

[22] Filed: Jun. 9, 1977

[51] Int. Cl.[2] ..... A42B 1/18

[52] U.S. Cl. ..... 2/177; 2/182.6; 2/12; 135/20 R

[58] Field of Search ..... 2/177, 182.6, 180, 191, 2/196, 12, DIG. 11, 10, 185 R; 135/20 A, 20 R, 19.5

[56] References Cited

U.S. PATENT DOCUMENTS

| | | | |
|---|---|---|---|
| 250,803 | 12/1881 | Gray | 2/182.6 |
| 2,788,523 | 4/1957 | Seguin | 2/12 |
| 3,305,201 | 2/1967 | Thiel | 2/177 X |
| 3,486,514 | 12/1969 | Prescott | 135/20 R |
| 3,585,643 | 6/1971 | Ryan | 2/177 |

FOREIGN PATENT DOCUMENTS

| | | | |
|---|---|---|---|
| 485,640 | 10/1953 | Italy | 2/177 |
| 440,064 | 10/1948 | Italy | 135/19.5 |

*Primary Examiner*—Peter Nerbun
*Attorney, Agent, or Firm*—Warren F. B. Lindsley

[57] ABSTRACT

A sun shield comprising a flat heat insulating element mountable above and spaced from the head of a wearer by an arm member pivotally supported on a flexible head band. The arm member is also pivotally attached to the insulating element so that the insulating element may be moved to shade the top and all sides of the head of the wearer through adjustments of the arm member and rotation of the head band.

2 Claims, 6 Drawing Figures

SUN SHIELD

BACKGROUND OF THE INVENTION

This invention relates to sun shields for the head of a wearer and more particularly to one which may be easily adjustable to cover not only the head of the wearer but, if so desired, any side thereof while still maintaining adequate ventilation and comfort for the wearer in its numerous positions.

DESCRIPTION OF THE PRIOR ART

Various types of hats have been provided for head protection from the sun while striving for adequate ventilation of the head. However, these known types of sun hats have a securing structure which inevitably restricts ventilation and results in discomfort to the wearer. U.S. Pat. No. 3,089,145 discloses a flat circular disk of polished metal having four spaced projections extending downwardly from the underside thereof to which is secured downwardly projecting rods, the lower ends of which are secured to a spring clip for engaging the temple bars of a pair of spectacles.

U.S. Pat. No. 3,585,643 discloses a sun hat including a disk for protecting the head, a flexible head band and a pair of flexible straps having their opposite ends secured to the head band. An intermediate portion of the strips are threaded slidable through slots in the disk whereby the disk is adjustable to different angular positions of the head by relative slidable movement of the straps.

U.S. Pat. Nos. 250,803; 1,418,198 and 1,761,368 disclose further hats employing shields which are held in one or more places by various head attachment means.

None of the hats disclosed in these patents satisfy all of the requirements desired in a hat of this kind, namely, to protect all sides and the top of the head by a simple easily adjustable support member and at the same time providing good circulation of air around the head in any of its positions on the head, comfortable to wear in any of its numerous positions, and inexpensive to manufacture, even though it may be used over and over again.

SUMMARY OF THE INVENTION

In accordance with the invention claimed, an improved sun shield or hat is disclosed which may be adjusted for shading the top and all sides of the head and neck of the wearer while still maintaining adequate head ventilation and comfort for the wearer.

It is, therefore, one object of this invention to provide an improved sun shield or hat which provides a sun protecting shield for the head of the wearer in a plurality of positions and affords adequate ventilation for the scalp while spaced from the head in all of its positions.

Another object of this invention is to provide an improved sun hat which is light in weight, comfortable to wear and which may be adapted to fit all shapes and sizes of heads.

A further object of this invention is to provide an improved sun shade mountable on the head of the wearer by means of a head band through a single support arm which is pivotally attached to the head band and to a flat sun shield member for pivotal adjustment at each end of the arm.

A still further object of this invention is to provide an improved sun shield for head wear of the type disclosed which is simple in construction and lends itself to manufacture at a low cost.

Briefly, the improved sun shield comprises a flat heat insulating member spacedly positioned above the head of the wearer and moveable to any side of the head by suitable adjustments of a single support arm and head band.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
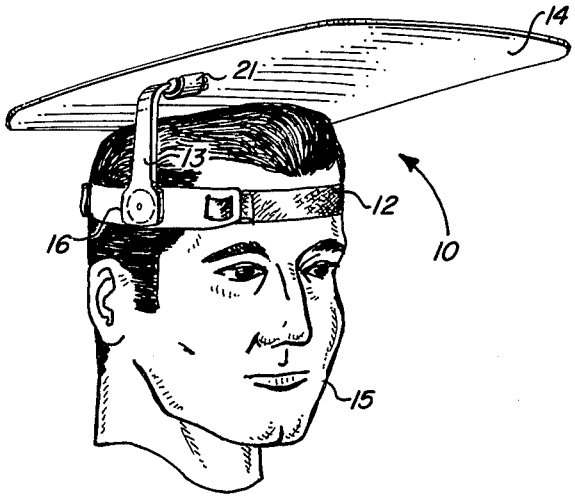
FIG. 1 is a front and side perspective view of the sun shield mounted on a wearer and embodying features of the invention.

Referring more particularly to the drawing by characters of reference, FIG. 1 discloses a lightweight structurally strong hat or sun shield 10 for providing insulation or shielding of the sun's rays from the top and all sides of the head of a wearer.

As shown in FIGS. 1–6, the shield comprises a flat shielding member 11 which is shown as a square shaped configuration, but it should be understood that it may be of any suitable configuration such as round, elliptical, rectangular, etc. Member 11 may be formed of any suitable lightweight material but preferably it should be formed of a non-heat conductive material such as a thin resilient plastic, paper, foam rubber or the like of a thickness to retain its form and provide good insulation from the sun.

A head band 12 is utilized for supporting an arm member 13 which is pivotally attached to the bottom 14 of shielding member 11 for holding the shielding member on the head 15 of a wearer.

Figure 4:
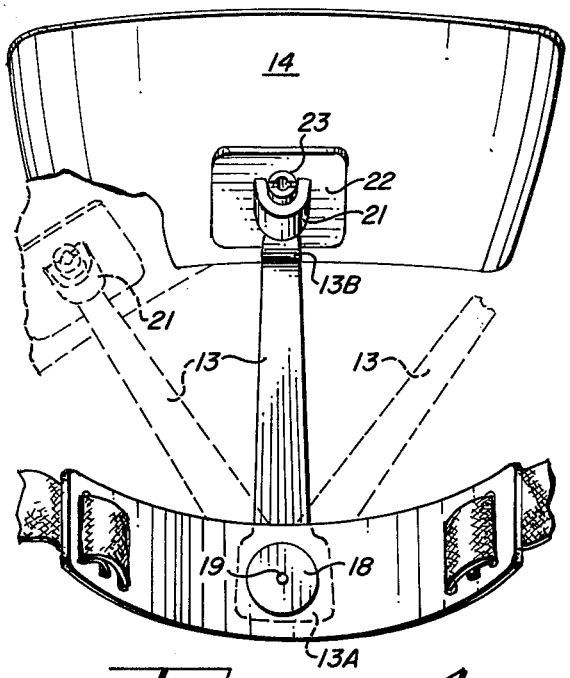
FIG. 4 is an enlarged partial view of the sun shield showing the supporting arm for head protecting member with the arm shown in dash lines in two other positions.

As shown in the drawing, the head band 12 comprises an elongated arcuate portion 16 formed of resilient plastic to the ends of which is attached in a suitable manner the ends of an expandable, resilient rubberized cloth strip-like material 17. If desired, the entire head band 12 may be elastic; however, it is desirable to pivotally mount one end of the arm member 13 on a rigid body, and accordingly, it is desirable to pivotally mount it on the arcuate portion 16 of the head band 12 to provide a means for pivotally mounting that end of the arm member 17 relative to arcuate portion 16, as shown in FIG. 4. The pivotal connection may comprise a plastic washer 18 having an integral pin 19 extending axially therefrom in a snug manner through an aperture in arcuate portion 16 of the head band 12 into the end 13A of the arm member 13.

Figure 2:
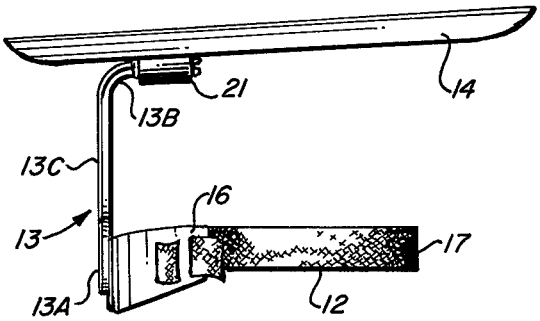
FIG. 2 is a partial side view of the sun shield shown in FIG. 1.
Figure 3:
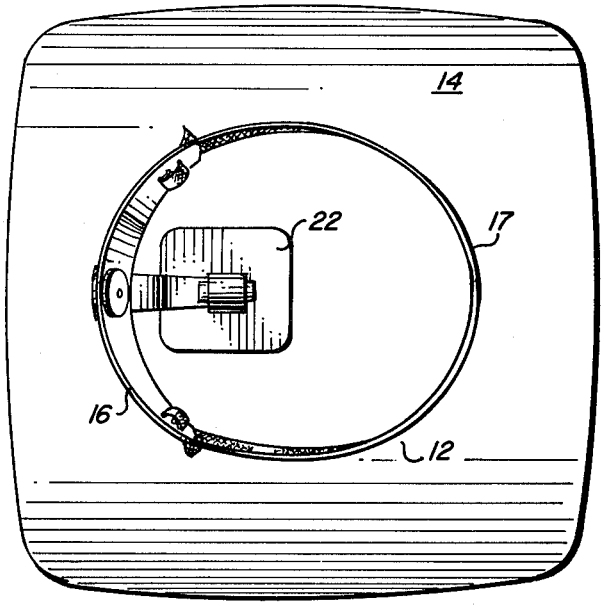
FIG. 3 is a bottom view of the sun shield shown in FIGS. 1 and 2.
Figure 5:
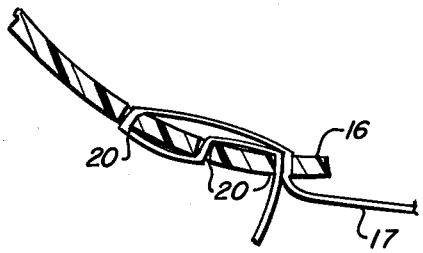
FIG. 5 is an enlarged partial view of the head band adjustment means.
Figure 6:
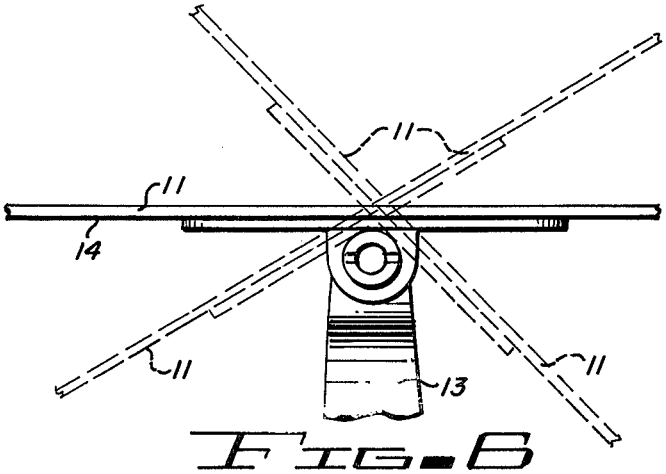
FIG. 6 is an enlarged partial view of the pivotal attachment means of the support arm to the head protecting member and by dash lines the head protecting member in two other positions.

FIGS. 2, 4 and 5 illustrate that the ends of material 17 are looped through openings 20 spacedly positioned in and along the length of the ends of the arcuate portion 16 of the head band to permit, in a known manner, the length adjustment of the material 17 to provide a head band to fit comfortably the head of any wearer. The slots 20 are of a size to permit slidable movement of the ends of the strip-like material 17 therethrough.

According to the invention, the head band 12 holds the shielding member 11 above the head of the wearer or at a plurality of positions on all sides of the head through adjustable movement of the arm member 13 and in some instances by the combined movement of it and the head band around the head of the wearer.

As shown in FIGS. 1–4 and 6, end 13B of the arm member 13 extends laterally from the longitudinal axis of its center portion 13C and fits into a U-shaped clamp-like member 21 which is suitably secured to a plate 22 secured to the bottom 14 of shielding member 11 at substantially the center thereof. Although the arm member 13 is shown as being formed of a thin strip of resilient plastic, its end 13B is provided with a cylindrical bearing member 23 of suitable material such as plastic for pivotally fitting into the opening formed by the U-shaped clamp-like member 21.

It should be noted from the figures of the drawing that the head band may be mounted on the head of a wearer such that the arm member 13 extends upwardly from one side of the head with the shielding member 11 arranged in a substantially horizontal position. The shielding member may be left in this position to shade the head or it may be rotated about the longitudinal axis of portion 13B of the arm member 13 to partially shade one side or the other of the head of the wearer.

The shielding member may be moved further over the side of the head of the wearer by further pivotal movement of arm member 13 about pin 19 and its position in the arcuate portion 16 of the head band 12. It should be noted that it is possible to position the shielding member 11 so that there is always a ventilating space between the bottom surface 14 of the shielding member and the head of the wearer.

Although but one embodiment of the present invention has been illustrated and described, it will be apparent to those skilled in the art that various changes and modifications may be made therein without departing from the spirit of the invention or from the scope of the appended claims.

What is claimed is:

1. A sun shield for providing shade for the head of a wearer comprising:

a substantially flat thin resilient sun shielding member, an elongated arm member, a first means for pivotally attaching one end of said arm member to the bottom of said shielding member, the bottom of said shielding member being provided with a U-shaped clamp for receiving and providing a bearing surface for said one end of said arm member, a flexible head band having an elastic portion to provide a gripping connection on the head of a wearer, and a second means for pivotally attaching the other end of said arm member to the side of said head band, said head band being provided with a resilient arcuate plastic portion to which said second end of said arm member is pivotally attached, whereby the pivotal movement of said shielding member relative to said one end of said arm member and the pivotal movement of one end of said arm member relative to said head band provides a plurality of shielding positions of said shielding member relative to and spaced from the head of the wearer.

2. The sun shade set forth in claim 1 wherein:

said arm member is formed of a flat strip of plastic material having a tubular bearing surface at said one end thereof for fitting into said U-shaped clamp.

* * * * *